US006658910B1

(12) United States Patent
Gerth et al.

(10) Patent No.: US 6,658,910 B1
(45) Date of Patent: Dec. 9, 2003

(54) ROLLER DEVICE AND METHOD FOR ADJUSTING SAID DEVICE

(75) Inventors: Volker Gerth, Schieder-Schwalenberg (DE); Josef Horstmann, Luegde (DE)

(73) Assignee: Karl Fuhr GmbH & Co. KG, Horn-Bad Meinberg (DE)

( * ) Notice: Subject to any disclaimer, the term of this patent is extended or adjusted under 35 U.S.C. 154(b) by 0 days.

(21) Appl. No.: 09/868,234

(22) PCT Filed: Oct. 17, 2000

(86) PCT No.: PCT/DE00/03641

§ 371 (c)(1),
(2), (4) Date: Jul. 30, 2001

(87) PCT Pub. No.: WO01/28704

PCT Pub. Date: Apr. 26, 2001

(30) Foreign Application Priority Data

Oct. 17, 1999 (DE) ..... 199 49 869
Jan. 26, 2000 (DE) ..... 100 03 126

(51) Int. Cl.[7] ..... B21B 13/10

(52) U.S. Cl. ..... 72/224; 72/7.1; 72/10.1; 72/10.7; 72/14.8

(58) Field of Search ..... 72/7.1, 7.2, 8.2, 72/9.5, 10.1, 10.7, 14.8, 15.1, 224, 235, 249, 6.2; 700/148, 149

(56) References Cited

U.S. PATENT DOCUMENTS 5,000,020 A * 3/1991 Rohde et al. ..... 72/225
5,090,227 A * 2/1992 Takeda et al. ..... 72/224
5,566,564 A 10/1996 Brauer
5,949,684 A * 9/1999 Kirkwood-Azmat ..... 700/148
6,044,675 A * 4/2000 Davi ..... 72/711

* cited by examiner

*Primary Examiner*—Ed Tolan
(74) *Attorney, Agent, or Firm*—Birch, Stewart, Kolasch & Birch, LLP

(57) ABSTRACT

A rolling apparatus is proposed with four rolls arranged in the shape of a star whereby one drive unit each is assigned to the rolls and whereby an adjusting unit each precedes the rolls through which the rolls are arranged adjustably in a radial and an axial direction. The separate and comprehensive triggering of the individual rolls (3) always allows a symmetrical introduction of the rolling stock to and through the rolling apparatus.

9 Claims, 2 Drawing Sheets

ROLLER DEVICE AND METHOD FOR ADJUSTING SAID DEVICE

This application is the national phase application under 35 U.S.C. §371 of PCT International Application No. PCT/DE/00/03641 which has an International filing date of Oct. 17, 2000, which designated the United States of America and was not published in English.

BACKGROUND OF THE INVENTION

The present invention relates to a rolling apparatus for the rolling of metallic rods or wire featuring a mount and containing the following: several rolls arranged in the shape of a star in a mount, a drive unit driving at least one roll and one coupler unit transmitting to the roll the torque produced by the drive unit.

RELATED ART

From DE 43 08 449 A1 a rolling apparatus for the rolling of metallic rods or wire is known which has a number of rods arranged in the shape of a star. The rolling apparatuses are arranged in series along a longitudinal axis of the rolling stock. The rolls of a rolling apparatus are effectively linked with a single drive unit each assigned to a rolling apparatus through a coupler unit. The fact that every roll of a rolling apparatus is driven separately enables a larger degree of forming of the rolling stock which facilitates a reduction of the rolling apparatuses under a rolling system. Also, this arrangement can reduce the risk of the rolling stock slipping through. However, the known rolling apparatus has the disadvantage that it requires a voluminous and rather complicated coupler unit with several transmission steps to transmit to the rolls the torque produced by the drive unit.

SUMMARY OF THE INVENTION

The object of the present invention is therefore to develop a rolling apparatus for the rolling of metallic rods or wire such that the rolling apparatus has a compact structure and provides reliable and effective rolling.

To attain the object of the present invention, the rolling apparatus in accordance with the present invention is characterized, in connection with the preamble of patent claim 1, in that each roll has its own drive unit assigned.

The particular advantage of the rolling apparatus in accordance with the present invention is that the rolling apparatuses can be shaped in a uniform and space-saving way. Advantageously, the rolling apparatuses of a rolling system can be easily exchanged whereby the number of revolutions per roll of one rolling apparatus can be realized by way of directly operative selection measures from the drive unit.

In accordance with a preferred embodiment of the invention, the drive unit is arranged out-of-line of the longitudinal surface of the mount such that the drive unit is not located on the operative level of the rolling apparatus and the rolls, respectively. On the one hand such a design allows a more stable and rigid mount, on the other it facilitates an improved access to the rolls which means a faster exchange of rolls.

In accordance with one development of the rolling apparatus in accordance with the present invention, gearwheels will be used for the coupling of a drive shaft of a drive unit arranged laterally out-of-line with respect to a coupler rod running in a longitudinal direction of the roll inside the mount. This facilitates simple and safe coupling between the laterally arranged drive unit and one roll.

The known rolling apparatuses for the rolling of metallic rods or wire have four rolls arranged in the shape of a star whereby parallel rotational axes of opposing rolls are arranged retrograded in the direction of the rotational axis (so-called Türkenkopf arrangement). These particularly shaped rolling apparatuses are preferably utilized for the rolling of rods and wire with a rectangular cross-section. When a rolling apparatus needs to be retrofitted for a rolling stock with a different cross-section it will be sufficient to change the position of two rolls only. However, a disadvantage of this retrofitting process is that it generally causes an incongruity of the longitudinal axis of the rolling stock and a central axis of the rolling apparatus.

The object of the present invention is therefore to develop a rolling apparatus for the rolling of metallic rods or wire such that the rolling stock can always be led in a central position of the rolling apparatus irrespective of the shaping.

To achieve this object, the rolling apparatus in accordance with the present invention in connection with the preamble of patent claim 6 is characterized in that the drive unit includes an adjusting unit with which every roll can be moved in both radial and axial directions with respect to the individual rotational axis of said roll.

It is an advantage that the rolling apparatus in accordance with the present invention always ensures a symmetrical arrangement of the rolls to each other. In connection with guiding elements arranged before and after the rolling apparatus, the rolling stock can therefore be moved in a centered position irrespective of the rolling stock's cross-section. An undesired impact of lateral powers through guiding elements arranged before or after the rolling apparatus is effectively excluded by this approach. Another advantage is the resulting reduced time required for retrofitting. Moreover, said arrangement makes the rolling process more reliable.

Another object of the present invention is to offer a selection device for a rolling apparatus, which ensures a simple and safe positioning of the rolls in a predetermined operational position, whereby at least one roll that is effectively linked to a drive unit via a coupler unit is provided drivable.

To achieve this object the selection device in accordance with the invention in connection with the preamble of patent claim 9 is characterized in that one additional control unit is provided which acts upon at least one roll via an adjusting unit such that the roll can be moved into a predetermined position according to programmed data.

Advantageously, the selection device in accordance with the present invention allows for a safe and reliable adjustment of the rolling apparatus to accommodate a predetermined cross-section of the rolling stock. Advantageously, a data processing unit and a trimming program can be used to provide a user-friendly control of the set operational position of the rolls. Modified adjustment data can be easily entered into an input unit of the data processing unit and processed in said unit by means of a control unit to actuate the respective roll. Hence the selection device in accordance with the invention allows both a faster and a more reliable retrofitting.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 depicts a rolling apparatus 1 with a plate-shaped mount 2 which contains in its central area rolls 3 in a star-shaped arrangement. The rolls 3 facing opposite each other have parallel rotational axes 4 arranged out-of-line with respect to one another in the direction of their rotational axes 4. To those skilled in the art this given configuration of the rolls 3 is known as Türkenkopf, see FIG. 3.

Figure 1:
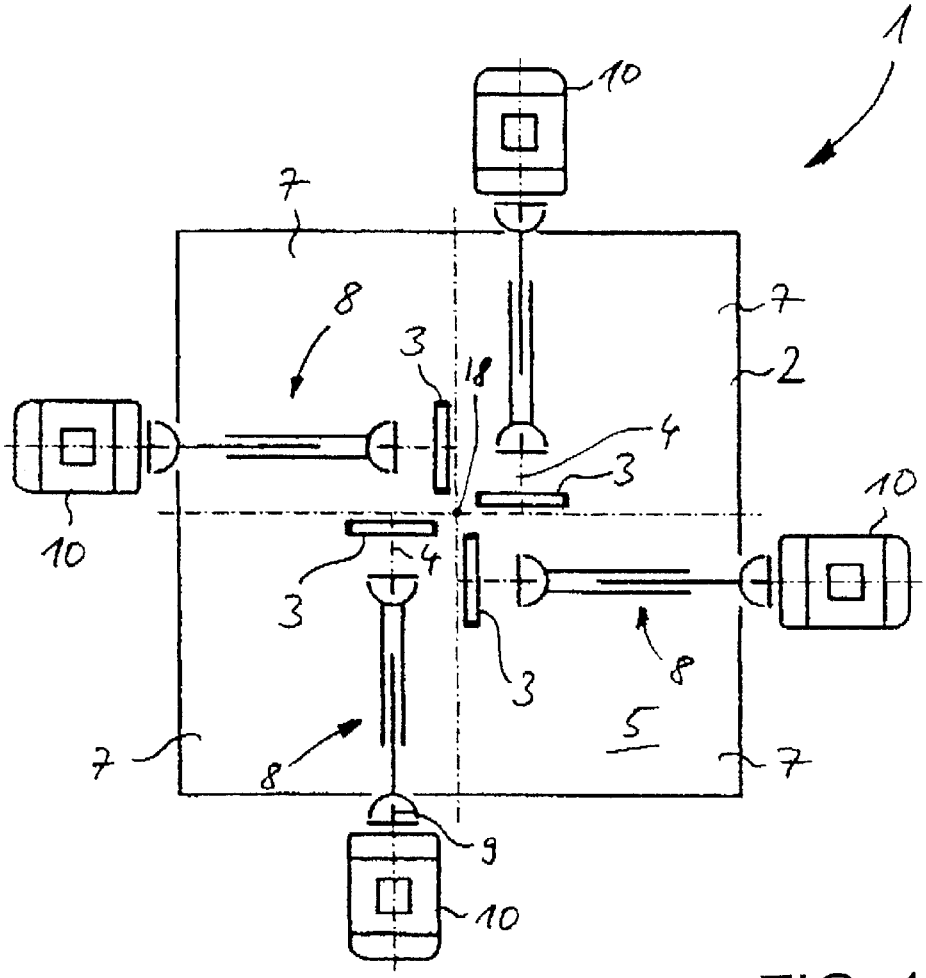
FIG. 1 depicts a schematic view of a rolling apparatus.

The mount 2 is essentially shaped as a cuboid with external surfaces arranged in a rectangular position to each other. The mount 2 has opposing and parallel large longitudinal surfaces 5 and a multitude of narrow surfaces 6 adjacent to the latter. The rolls 3 are each arranged in a central lateral area of sectional quadrants 7 of the mount 2. From each of the three rolls 3, a coupler unit 8 extends in the direction of the edge of the mount 2, which preferably includes a coupled rod assembly and is geared, on the one hand, with a shaft of the roll 3 (not shown), and, on the other, with a drive shaft 9 of a drive unit 10 arranged in the lateral area of the mount 2.

Figure 2:
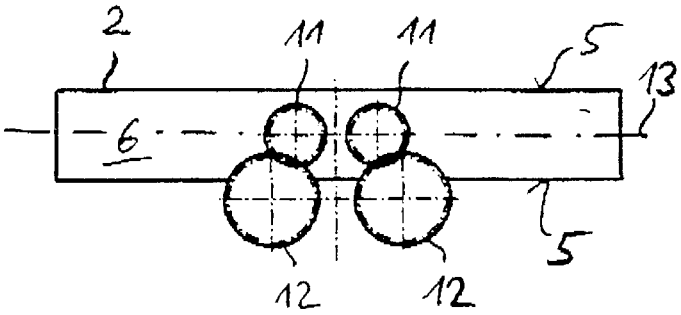
FIG. 2 depicts a lateral view of the rolling apparatus.

A coupler unit 8 and a drive unit 10 are assigned individually to each roll 3. The drive unit 10 extends with its drive shaft 9 coaxially with respect to the assigned roll 3. As can be seen from FIG. 2, two geared gearwheels 11 and 12—whereby gearwheel 11 is linked to the coupled rod assembly and gearwheel 12 is linked to the drive shaft 9 of the drive unit 10 allow the drive unit 10 to be arranged in parallel out-of-line with respect to the mount 2 and out-of-line with respect to one central longitudinal axis 13 of the mount 2, respectively. The drive unit 10, which is preferably provided as an electric motor, is arranged with such distance to the mount 2, whereby access to the rolls 3 is not obstructed. Consequently, it is possible to select and/or operate the rolls 3 independently.

Figure 3:
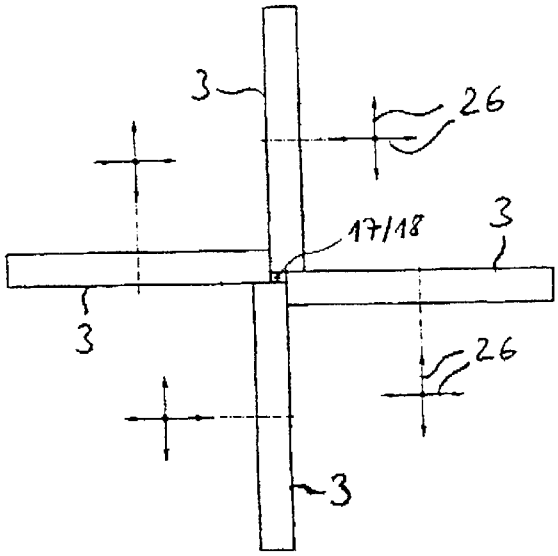
FIG. 3 depicts a schematic representation of an arrangement of rolls in accordance with the so-called Türkenkopf.
Figure 4:
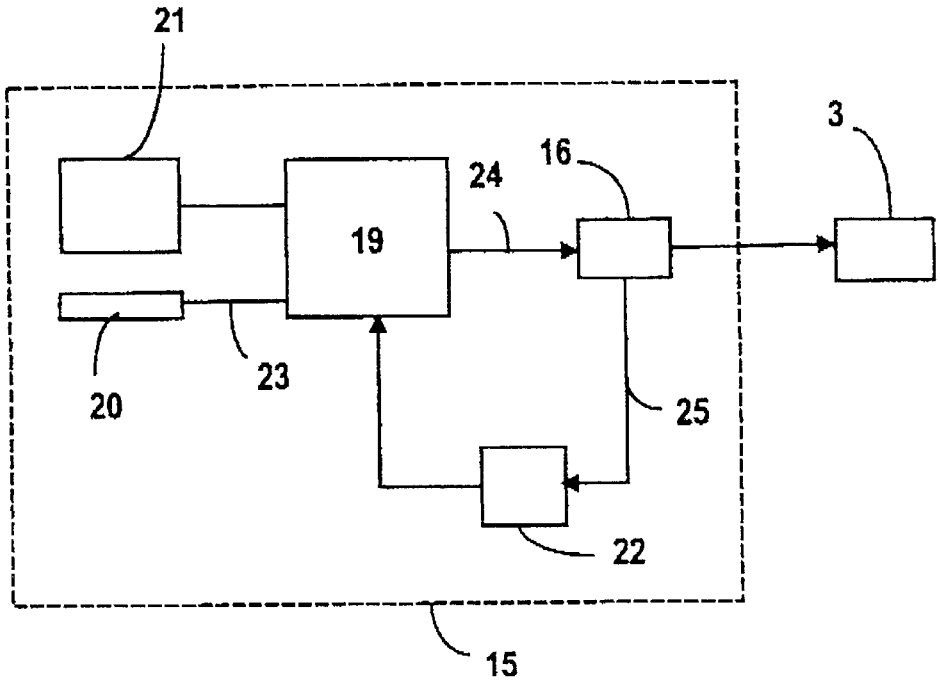
FIG. 4 depicts a block diagram of a selection device for a rolling apparatus.

Pursuant to another embodiment of the present invention and in accordance with FIGS. 3 and 4, a rolling apparatus 15 is envisaged, which essentially has the same design as the rolling apparatus 1 in accordance with the first embodiment. In contrast to the first embodiment, the rolls 3 are effectively linked to an adjusting unit 16 by means of a coupler unit, which is not shown, such that the rolls 3 are each adjustable in radial and/or axial directions, see arrow 26 in FIG. 3. The adjusting unit 16 preferably has servo drives, which are not shown, for each direction of movement. Advantageously, during retrofitting, this allows one to obtain a position of rolls where one longitudinal axis of the rolling stock 17 always coincides with a central axis 18 of the rolling apparatus 1. The central axis 18 is preferably a symmetrical axis of the mount 2 and/or a guiding axis along which the rolling stock is guided by means of guiding elements arranged between adjacent rolling apparatuses. Such a rolling system preferably comprises a multitude of rolling apparatuses 1 and/or 15 with the guiding means arranged between these apparatuses.

In the case where the widths of the rolling stock vary, the adjusting unit 16 simultaneously controls a right roll 3 in a radial direction and a lower roll 3 in an axial direction such that these rolls 3 can e.g. be moved to the right side. Correspondingly, the upper and left rolls 3 are simultaneously controlled in an axial and a radial direction, respectively, such that a predetermined longitudinal axis of the rolling stock 17 remains unchanged. The same paired selection of rolls 3 takes place when the rolling stock is adjusted in height whereby in this case the upper and the right rolls 3 and the left and lower rolls 3, respectively, are controlled as pairs.

Alternately, it is possible to adjust the width and the height simultaneously, whereby all rolls 3 are selected simultaneously.

Alternately, the adjusting unit 16 can also have only one single servo drive each, whereby a deflector device integrated in the coupler unit 8 ensures that a roll 3 is movable in a radial or an axial direction as selected.

For the selection of the described rolling apparatuses 1, 15, a selection device can be provided which essentially is comprised of a control unit 19, an input unit 20, a display unit 21 and a measurement device 22.

The control unit 19 can be provided as a data processing device with a micro processor and a memory. The control unit 19 is connected to a screen as a display unit 21 and a keyboard as an input unit 20. By means of the input unit 20, an operator can enter programmed data 23 for the positioning of the rolls 3. The control unit 19 converts the programmed data 23 to control signals 24, which can be processed by the adjusting unit 16 and which actuate the servo drives integrated in the adjusting unit 16. Along a feedback path 25, the adjusting unit 16 is connected with the control unit 19 via the measurement device 22, which has a position transmitter and that provides continuously current positioning data of the respective roll 3 to the control unit 19. Inside the control unit 19, this current positioning data is compared with the programmed data 23, and the control signal 24 will actuate the adjusting unit 16 until the difference between the programmed data 23 and the current positioning data is zero. In this way, a positioning of the rolls 3 can be achieved swiftly and reliably.

In accordance with another embodiment of the selection device, the memory of the control unit 19 can hold a trimming program and the positioning data of a reference roll such that during retrofitting only corrective values, which represent the deviation from the predetermined fixed position of the reference roll, must be entered via the input unit. The positioning data of the reference roll can therefore serve as a reference whereby the operator only needs to enter the corresponding identification that stands for a specific rolling program. Thus, it can be avoided that digits must be entered manually which usually is rather cumbersome and tends to be a source of errors. At least it is possible to simplify the input by entering digits as corrective data.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A selection device for a rolling apparatus for the rolling of metallic rods or wire, wherein at least one roll, effectively linked with one drive unit via a coupler unit, is drivable, said selection device comprising:

a control unit which actuates at least one roll by an adjusting unit such that the roll is automatically positioned pursuant to programmed data corresponding to a predetermined position, wherein said control unit further includes a memory having a trimming program stored therein; and a measurement unit for providing current positioning data to the adjusting unit, wherein the control unit further processes modified adjustment data, which is entered by an operator via an input unit during positioning of the roll, to manually adjust the automatic positioning of the roll.

2. The selection device in accordance with claim 1, wherein the control unit further includes a micro processor and wherein a program for the processing of the programmed data is included in the memory.

3. The selection device in accordance with claim 2, wherein the adjusting unit is connected along a feedback path to the control unit via the measurement device, and wherein, the control unit is connected to the input unit for the entry of the programmed data and that upon comparison of the programmed data with the current positioning data, the control unit generates a control signal for the selection of the adjusting unit until the roll has taken the predetermined operational position.

4. A method for trimming a rolling apparatus, having a selection device for a rolling apparatus for the rolling of metallic rods or wire, wherein at least one roll, effectively linked with one drive unit via a coupler unit, is drivable, said selection device comprising:

a control unit which actuates at least one roll by an adjusting unit such that the roll is positioned pursuant to programmed data corresponding to a predetermined position, wherein the control unit further includes a micro processor and wherein a program for the processing of the programmed data is included in the memory, wherein the adjusting unit is connected along a feedback path to the control unit via the measurement device, and wherein the control unit is connected to an input unit for the entry of the programmed data and that upon comparison of the programmed data with the current positioning data the control unit generates a control signal for the selection of the adjusting unit until the roll has taken the predetermined operational position, the method comprising:

running, during setup of the rolling apparatus, a trimming program that is stored in a memory of a control unit, whereby current positioning data of a reference roll is fed into a display unit coupled to the control unit representing the current positioning data, and depending on data entered into the input unit, a control signal is generated inside the control unit to actuate an adjusting unit.

5. The method according to claim 4, wherein the correcting data entered into the input unit represents a difference with respect to the positioning data of the reference roll.

6. The method according to claim 4, wherein programmed data is be fed into the input unit and depending on the entered input data correcting data is computed in the control unit to generate a corresponding control signal for triggering the adjusting unit.

7. A selection device for a rolling apparatus that rolls metallic rods or wire, said selection device comprising:

a control unit for actuating at least one roll of the rolling apparatus, such that the roll is automatically positioned pursuant to programmed data corresponding to a predetermined position, said control unit further including a microprocessor and a memory, said memory containing a program for processing said programmed data;

an adjusting unit, operatively connected to at least one roll by a coupler unit, for adjusting at least one roll in an axial and radial position via an input from said control unit;

a measurement device, which includes a position transmitter, for providing said control unit with current positioning data of at least one roll; and an input unit for providing said control unit with said programmed data, wherein said-control unit actuates said at least one roll, via said input to said adjusting unit, based on a comparison between said current positioning data and said programmed data, and wherein the control unit further processes modified adjustment data, which is entered by an operator via the input unit during positioning of the roll, to manually adjust the automatic positioning of the roll.

8. The selection device of claim 7, wherein said selection device further includes a display device for displaying data.

9. The selection device of claim 7, wherein said measurement device continuously provides said current positioning data to said control unit.

* * * * *